US007507697B1

(12) United States Patent
Shertok et al.

(10) Patent No.: US 7,507,697 B1
(45) Date of Patent: Mar. 24, 2009

(54) METHOD FOR THE OXIDATIVE CLEANING OF FOOD PROCESSING EQUIPMENT

(75) Inventors: Joel Terry Shertok, Rochester, NY (US); Jack David Fox, Kendall, NY (US)

(73) Assignee: Rochester Midland Corporation, Rochester, NY (US)

( * ) Notice: Subject to any disclaimer, the term of this patent is extended or adjusted under 35 U.S.C. 154(b) by 0 days.

(21) Appl. No.: 11/928,324

(22) Filed: Oct. 30, 2007

(51) Int. Cl.
*C11D 1/72* (2006.01)

(52) U.S. Cl. ..... 510/218; 510/222; 510/224; 510/228; 510/233; 510/372; 134/25; 134/26; 134/34; 134/40; 134/42

(58) Field of Classification Search ..... 510/218, 510/222, 224, 228, 233, 372, 375
See application file for complete search history.

(56) References Cited

U.S. PATENT DOCUMENTS 3,715,976 A * 2/1973 Krakowski ..... 99/404
4,243,543 A 1/1981 Guilbert et al.
5,320,805 A 6/1994 Kramer et al.
5,567,444 A 10/1996 Hei et al.
5,855,217 A 1/1999 John
5,861,366 A 1/1999 Ihns et al.
5,876,514 A * 3/1999 Rolando et al. ..... 134/25.2
6,472,360 B1 * 10/2002 Beggs et al. ..... 510/372
6,562,145 B2 * 5/2003 Duckett et al. ..... 134/27
6,686,324 B2 2/2004 Ramirez et al.
6,998,376 B1 2/2006 Tyborski et al.
2006/0042665 A1 3/2006 Fernholz et al.
2006/0046945 A1 3/2006 Herdt et al.

* cited by examiner

*Primary Examiner*—Mark Eashoo
*Assistant Examiner*—Mohammad R Asdjodi
(74) *Attorney, Agent, or Firm*—Browns & Michaels, PC

(57) ABSTRACT

A method for cleaning the surfaces of food processing equipment that are heavily soiled with food processing byproducts, such as grease, starch and proteinaceous materials. The cleaning method consists of applying two separate aqueous cleaning solutions that are mixed together. One solution contains an aqueous oxidizing agent and the other solution contains a source of aqueous hydroxide ions. Both solutions are mixed together immediately prior to being applied to the soiled surfaces. The combined formulation utilizes the weak Bronsted acidity of the oxidizing agents in interaction with the hydroxide ions to generate perhydroxyl ions and other active oxygen species, which are significantly more effective at cleaning heavily soiled food processing equipment than each cleaning solution alone.

24 Claims, No Drawings

METHOD FOR THE OXIDATIVE CLEANING OF FOOD PROCESSING EQUIPMENT

FIELD OF THE INVENTION

The invention pertains to the field of cleaning heavily soiled surfaces in the food processing industry. More particularly, the invention pertains to a method for the periodic cleaning of heavily soiled food processing equipment either on site or after dissembling the soiled equipment.

BACKGROUND OF THE INVENTION

In food processing industries where grease, protein, starch, etc. build up into layers of varying thickness and soil the surfaces of equipment, processes must be periodically shut down for equipment cleaning. Various formulations and methods have been used in an attempt to resolve this problem. Conventional formulations have included various surfactants with alkaline cleaning agents containing chlorine. Due to the presence of chlorine in the alkaline agent, the longer molecular structures of the protein, starch and grease components are cleaved into shorter molecular structures which are then capable of being emulsified by surfactants and flushed away.

One problem associated with such formulations is that the chlorine content of the cleaning solutions creates a negative environmental impact. Furthermore, chlorine accelerates the corrosion of metallic components, as well as the degradation of various rubber gaskets and seals. It is therefore desirable to formulate solutions for cleaning heavily soiled surfaces in the food processing industry which avoid the problems caused by using conventional chlorine-based formulations.

Various attempts have been made to achieve the desired result of cleaning these heavily soiled surfaces while not compounding environmental pollution. For example, U.S. Pat. No. 5,567,444 discloses the use of potentiated ozone as a cleaning agent. The ozone is generated by creating an electrical charge to contact a solution containing hydrogen peroxide and peroxyaliphatic carboxylic acid. Although ozone is known to have a relatively short lifetime after being generated, one of the disadvantages of using this molecule relates to its status as a possible environmental hazard since it is known to be a major contributor to the formation of smog in urban areas.

U.S. Pat. No. 5,855,217 discloses a device for cleaning soiled food processing equipment in which a hydrogen peroxide solution containing an alkyl amine oxide is added to a chlorine free alkaline foam cleaning agent no more than 1 minute prior to application to the soiled surface to be cleaned. The alkaline cleaning agent is foamed before being mixed with the hydrogen peroxide solution. The examples show a cleaning efficiency rate of only between 41.5% and 75.5%, which may be acceptable under some, although not all, industrial cleaning operational standards.

In U.S. Pat. No. 5,861,366, the patentees disclose the use of enzymes plus surfactants to clean soiled food processing equipment. They mention a number of conventional formulations that may be combined with these enzymes to augment the cleaning process. They emphasize that their formulation is free of chlorine and alkaline metal hydroxides. While enzymes may exhibit less negative environmental impact, they typically lack the cleaning efficiency required in many industrial operations with limited time constraints.

Another approach is provided by the disclosure of U.S. Pat. No. 6,686,324 B1. This patent teaches a low foaming cleaning solution for cleaning and disinfecting medical and dental equipment by removing light organic soiling. The cleaning solution also includes a variety of surfactants, polyphosphates, sequestering agents and corrosion inhibitors. It is not suggested that this formulation be used to clean the heavily soiled surfaces of food processing equipment.

U.S. Pat. No. 6,998,376 B1 discloses a method and formulations for cleaning equipment used to prepare coffee. The alkaline cleaning solution contains at least one peroxidic compound generating about 1.5% active oxygen. No mention is made of utility in the cleaning of heavily soiled surfaces of the equipment used in the food processing industry.

Recent U.S. Patent Publications 2006-0046945 and 2006-0042665 disclose a method for the cleaning in place of soiled industrial equipment. However, they merely disclose a multistep process using conventional cleaning chemicals. They appear to claim that a pre-treatment, which can be either acidic or caustic, improves cleaning efficiencies. It is not clear, though, how this is an advancement over the known art.

What is desired is a more efficient formulation and method for use with "clean out-of-place" (COP), "clean-in-place" (CIP) and foam cleaning operations to remove heavy soil from surfaces of the equipment used in the food processing industry. This and other objectives will become apparent from the following detailed description of the invention.

SUMMARY OF THE INVENTION

The improvement consists of a method for cleaning the surfaces of food processing equipment that is heavily soiled with food processing byproducts, such as grease, starch and proteinaceous materials. This equipment must be cleaned on a regular basis to maintain processing efficiency and to prevent the proliferation of bacteria, viruses and other elements that can negatively affect human health.

The improved cleaning method consists of applying two separate cleaning compositions that are mixed together at the point of application to the soiled surfaces of food processing equipment. One composition contains an aqueous oxidizing agent and the other composition contains a source of aqueous hydroxide ions. Both compositions are mixed together immediately prior to being applied to the soiled surfaces. The cleaning formulation may be applied either as a foam or a gel in order to enhance residence time on the soiled surface. The cleaning compositions may also be applied as liquids. The combined formulation utilizes the weak Bronsted acidity of the oxidizing agents in interaction with the hydroxide ions to generate perhydroxyl ion and other active oxygen species that are significantly more effective at cleaning heavily soiled food processing equipment than each cleaning composition if applied separately.

DETAILED DESCRIPTION OF THE INVENTION

The improved cleaning process is a method of applying to the surfaces of heavily soiled food processing equipment a cleaning formulation including a combination of two separate cleaning compositions. In one embodiment, the two cleaning compositions are mixed together under pressure at the time of application to the surfaces of the food processing equipment by use of a conventional pressure spraying device. This type of on-site cleaning operation is referred to in the industry as "environmental sanitation" or "foam cleaning" or "hard surface cleaning", and is typically used to clean the exterior surfaces, walls and floors of food processing equipment. The pressure spraying device aerates the mixed compositions such that the cleaning formulation is ejected from the spray nozzle as either a gel or foam. The gel form is preferable in that it provides a greater surface residence time for the cleaning formulation, thereby improving cleaning performance. In an alternate embodiment of the invention, the two cleaning compositions are combined in water to form a low-viscosity mixture that is allowed to reside in or on soiled surfaces, or is recirculated through these surfaces for a pre-determined period of time. This type of cleaning operation is referred in the industry as "clean-in-place" (CIP) or "recirculation cleaning". A preferred CIP operation applies to its use in "boil out" or "fryer boil out" cleaning operations.

A first element [1A] of the first cleaning composition primarily provides a source of aqueous hydroxide ions. Preferably, alkali metal hydroxides are employed which include lithium hydroxide, sodium hydroxide, and potassium hydroxide. The preferred amount of alkali metal hydroxide in this cleaning composition is from about 0.1 percent by weight to about 50 percent by weight, based on the total weight of the first cleaning composition. The most preferred range is from about 25 percent by weight to about 45 percent by weight. In use, the first cleaning composition is diluted with water. Preferably, the dilution is from about 0.25 fl. oz. per gallon to about 64.0 fl. oz. per gallon. The preferred dilution range is from about 0.5 fl. oz. per gallon to about 15.0 fl. oz per gallon. The most preferred is a range of about 1.0 fl. oz. per gallon to about 5.0 fl. oz per gallon. In the most preferred range, the active hydroxide alkalinity level in the diluted solution is approximately 0.4% to approximately 2.0% by weight.

A second element [1B] of the first cleaning composition includes alkali metal salts of various homo- and heteropolymer soil dispersants and water scale inhibitors of the acrylate monomer type, having average molecular weights ranging from about 1,000 to about 12,000 g/mole. Examples of suitable materials include, but are not limited to: the homopolymer Acumer™ 1000; and the heteropolymers Acumer™ 2100, and Acumer™ 3100 from Rohm and Haas Co. The preferred amount of the second element is from about 0.1 percent by weight to about 5.0 percent by weight, based on the total weight of the first cleaning composition. The most preferred range is from about 0.5 percent to about 3.0 percent by weight.

A third element [1C] of the first cleaning composition includes alkali metal salts of organophosphonic acid soil dispersants and scale inhibitors. Examples of such materials include, but are not limited to: amino tris(methylenephosphonic acid) [Phos 2]; 1-hydroxyethylidene disphosphonic acid [Phos 6]; and 2-phosphono-1,2,4-butanetricarboxylic acid [Phos 9]; all available from Buckman Laboratories Inc. The preferred amount of the third element is from about 0.1 to about 5.0 percent by weight, based on the total weight of the first cleaning composition. The most preferred range is from about 0.5 to about 3.0 percent by weight.

A fourth element [1D] of the first cleaning composition includes surfactants. Examples of suitable surfactants include, but are not limited to: disodium cocoamphodipropionate (Miranol™ from Rhodia Inc.); alkyl polysaccacharide ether (Glucopon™ 225 DK from Cognis Inc.); monosodium N-lauryl-β-iminodipropionate (Deriphat™ 160-C from Cognis Inc.); sodium lauryl sulfacte; sodium octyl sulfate; and dodecyldimethylamine oxide (Ammonyx™ LO from Stepan Inc.). The preferred amount of the fourth element is from about 0.1 to about 10.0 percent by weight, based on the total weight of the first cleaning composition. The most preferred range is from about 0.5 to about 3.0 percent by weight.

A fifth element [1E] of the first cleaning composition includes various hydrotropes as phase coupling agents. Examples of suitable hydrotopes include, but are not limited to: sodium xylene sulfonate (SXS-40 from Pilot Inc) and sodium cumene sulfonate (Stepanate™ SCS-40 from Stepan Inc.). The preferred amount of this element is from about 0.1 to about 10.0 percent by weight, based on the total weight of the first cleaning composition. The most preferred range is from about 0.5 to about 3.0 percent by weight.

A sixth element [1F] of the first cleaning composition includes various inorganic salts as cleaning performance enhancing agents. Examples of suitable inorganic salts include, but are not limited to: sodium metasilicate pentahydrate (Metso Pentabead™ 20 from PQ Corp.); liquid potassium silicate (Kasil™ #1 from PQ Corp.); and sodium tripolyphosphate (from Hydrite Chemical Inc.). The preferred amount of this element is from about 0.1 to about 10.0 percent by weight, based on the total weight of the first cleaning composition. The most preferred range is from about 0.5 to about 3.0 percent by weight.

A seventh element [1G] of the first cleaning composition includes various carbon-containing molecules as wetting agents. Examples of suitable wetting agents include, but are not limited to: sodium gluconate (FCC Grade from Hydrite Chemical); block, graft and network heteropolymers of ethylene oxide and propylene oxide (Pluronic™ L-64 from BASF Inc.); and sodium glucoheptonate (Milco™ 150G from Milport Enterprises). The preferred amount of this material is from about 0.1 to about 10.0 percent by weight, based on the total weight of the first cleaning composition. The most preferred range is from about 0.5 to about 3.0 percent by weight.

An eight element [1H] of the first cleaning composition includes defoamers. Examples of suitable defoamers include, but are not limited to: polydimethylsiloxane emulsions (GE SAG™ 730 Silicone from GE Silicones) and non-silicone defoamers (Industrol™ DF-204 Defoamer from BASF). The preferred amount of this material is from about 0.001 to about 1.0 percent by weight, based on the total weight of the first cleaning composition. The most preferred range is from about 0.01 to about 0.5 percent by weight.

A ninth element [1J] of the first cleaning composition includes chelants and/or sequestrants. Examples of suitable molecules for this purpose include, but are not limited to: citric acid/sodium citrate; and methyltrinitriloacetic acid (Trilon™ M from BASF Inc.). The preferred amount of this element is from about 0.1 to about 10.0 percent by weight, based on the total weight of the first cleaning composition. The most preferred range is from about 0.5 to about 3.0 percent by weight.

The second cleaning composition provides a source of aqueous oxidizing agents. The primary element [2A] in this component is hydrogen peroxide, which is dissolved in water. The source of aqueous hydrogen peroxide may also be derived by dissolving various solid peroxygen compounds (persalts) such as alkali metal perborates, alkali metal percarbonates, alkali metal peroxymonosulfates and their hydrated forms. The preferred weight percentage of hydrogen peroxide is in the range of approximately 0.1 to 50 percent, based on the total weight of the second cleaning composition. More preferably, the amount is approximately 20 to 40 percent by weight, with the most preferred amount being approximately 30 to 35 percent by weight.

A second element [2B] of the second cleaning composition includes various organophosphonic acid soil dispersants and scale inhibitors. Examples of suitable compounds include, but are not limited to: amino tris(methylenephosphonic acid [Phos 2]; 1-hydroxyethylidene diphosphonic acid [Phos 6]; and 2-phosphono-1,2,4-butanetricarboxylic acid [Phos 9]; all available from Buckman Laboratories Inc. The preferred amount of the second element is from about 0.1 to about 10 percent by weight, based on the total weight of the second cleaning composition. The most preferred range is from about 1 to about 5 percent by weight.

A third element [2C] of the second cleaning composition includes oxygen bleach activators to generate surface-active peracids. Examples of suitable materials include, but are not limited to: C6-C8 alcohol ether carboxylic acid (Macat™ AEC-8964 from Mason Chemical Inc.); and C12 ether carboxylic acid (Macat™ AEC-126 from Mason Chemical Inc.). The preferred amount of this element is from about 0.1 to about 3.0 percent by weight, based on the total weight of the second cleaning composition. The most preferred range is from about 0.5 to about 1.2 percent by weight.

A fourth element [2D] of the second cleaning composition includes surfactants to boost cleaning performance. Examples of suitable surfactants include, but are not limited to: alkali metal n-octyl sulfonates (Bioterge™ PAS-8S from Stepan Inc.); decyldimethylamine oxide (Ammonyx™ DO from Stepan); octyldimethylamine oxide (FMB™ AO-8 from Lonza Inc.); and decyltrimethylammonium bromide (from Sigma-Aldrich Inc.). The preferred amount of this element is from about 0.1 to about 10 percent by weight, based on the weight of the second cleaning composition. The most preferred amount is from about 0.5 to about 3.0 percent by weight.

The method of the present invention includes the steps of preparing separate first and second cleaning solutions. Then, the first and second cleaning solutions are fed into a pressure spraying device which blends the two solutions with water and forces them out of a nozzle under pressure, such as by use of compressed air, toward the surface of the soiled food processing equipment.

Alternatively, the first cleaning solution is added to a mixing tank, recirculation tank or a fixed piece of food processing equipment such as a kettle, fryer, vat or some other part of the processing equipment that is capable of holding, and has been previously filled with, a volume of water. After complete dissolution of the first cleaning solution, the second cleaning solution is added to the existing aqueous mixture. The resulting blend is then mixed and allowed to contact the soiled surfaces by standing or by recirculation for a period of time sufficient to clean the soiled surface, followed by a water rinse.

The preferred amount of the aqueous hydroxide ion component, on a weight basis, from the first cleaning composition, in the final cleaning formulation is approximately 0.1% to approximately 5.0% active caustic. The most preferred amount is approximately 0.5% to 1.0% active caustic. The amount of aqueous oxidizing agent from the second cleaning solution, present in the final cleaning formulation is from approximately 0.1 fl. oz. to approximately 1.0 fl. oz. per gallon of the cleaning formulation. Most preferred is approximately 0.2 fl. oz. to approximately 0.8 fl. oz.

When utilized, the pressure spraying device can aerate the first and second cleaning solutions or premixed cleaning formulation so that it is applied as a foam, or it may be blended to form a gel, depending upon the proportions of the first and second cleaning compositions utilized. Examples of conventional foaming cleaning devices that can be employed include the Foam-It Foam King Single Pickup unit, the Lafferty Wall Mount Dual Pickup unit and the Lafferty Portable 2-Wheel LCDU Dual Pickup unit. The gel or foam is allowed to remain on the soiled surface for from approximately 5 to approximately 30 minutes, after which time it is rinsed off with potable water.

EXAMPLES

A) Brewery CIP

| | Amount: (based on the total weight of the first cleaning solution) |
|---|---|
| First cleaning solution: (designation) | |
| Sodium hydroxide (1A) | 35% |
| Sodium salt of amino(tris)methylene-phosphonic acid (1C) | 2.0% |
| Sodium salt of 2-phosphono-1,2,4-butane-tricarboxylic acid (1C) | 2.0% |
| Sodium salt of polyacrylic acid polymer (1B) | 2.0% |
| Second cleaning solution: (designation) | |
| Hydrogen peroxide (2A) | 33% |
| 2-phosphonobutane-1,2,4-tricarboxylic acid (2B) | 3.0% |
| C6-C8 alcohol ether carboxylic acid (2C) | 0.8% |

After every brewing cycle, the kettles and processing equipment are to be cleaned-in-place (CIP). The cleaning formulation was applied as a non-foaming solution with recirculating flow for the standard cleaning period of 30 minutes. The result was that the soiled equipment was completely cleaned. The benefit was that the level of hydroxide alkalinity was able to be reduced by 20% when compared to previously employed cleaning processes.

B) Environmental Sanitation/Foam Cleaning

| First cleaning solution: (designation) | Amount: (based on the total weight of the first cleaning solution) |
|---|---|
| Sodium salt of polyacrylic acid (1B) | 2.0% |
| Sodium octyl sulfate (1D) | 2.0% |
| Sodium lauryl sulfate (1D) | 2.0% |
| Sodium hydroxide (1A) | 35% |
| Second cleaning solution: (same as above) | |

The food processing equipment included 304 stainless steel. The cleaning formulation was applied as a foam to the food processing equipment and the surrounding floor areas. The result was that the food processing equipment was thoroughly cleaned and, of significance, the cleaning efficacy of the surrounding floor area improved by approximately 50% when compared to conventional cleaners.

C) Fryer boil out (CIP)

| First cleaning solution: (designation) | Amount (based on the total weight of the first cleaning solution) |
|---|---|
| Sodium hydroxide (1A) | 30% |
| Sodium salt of aminotrismethylenephos- | 2.0% |

-continued

C) Fryer boil out (CIP)

| First cleaning solution: (designation) | Amount (based on the total weight of the first cleaning solution) |
|---|---|
| phonic acid (1C) | |
| Sodium salt of polyacrylic acid (1B) | 2.0% |
| Second cleaning solution: (same as above) | |

The cleaning formulation was applied as a non-foaming solution into a convective clean-in-place (CIP) boil out operation. The normal cycle time of approximately 2 hours was reduced by 30 minutes due to the increased efficacy of the improved cleaning formulation.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for out of place cleaning of disassembled components of food processing equipment having soiled surfaces using a cleaning formulation containing an aqueous combination of hydroxide ion and an oxidizing agent, comprising the sequential steps of:

a) preparing a first aqueous cleaning solution comprising:
   i) from approximately 0.1 percent by weight to approximately 50 percent by weight, based on the total weight of the first cleaning solution, of an alkali metal hydroxide selected from the group consisting of lithium hydroxide, sodium hydroxide, potassium hydroxide, and a mixture of two or more of these ingredients, and
   ii) soil dispersants comprising alkali metal salts of acrylic polymers having an average molecular weight range of from about 1,000 to about 12,000 g/mole in an amount of from about 0.1 percent to about 5.0 percent by weight, based on the total weight of the first cleaning solution;

b) preparing a second aqueous cleaning solution comprising:
   i) from approximately 0.1 percent by weight to approximately 50 percent by weight, based on the total weight of the second cleaning solution, of a compound selected from the group of: hydrogen peroxide and a compound that generates hydrogen peroxide when dissolved in water;
   ii) from approximately 0.1 percent by weight to approximately 10 percent by weight, based on the total weight of the second cleaning solution, of a dispersant;
   iii) from approximately 0.2 to approximately 3.0 percent by weight, based on the total weight of the second cleaning solution, of a peroxide bleach activator that generates surface-active peracids;

c) combining the first aqueous cleaning solution with the second aqueous cleaning solution to generate perhydroxyl anion in a container selected from the group consisting of a pressure spraying device having a nozzle, a holding tank and a recirculation tank;

d) contacting the soiled surfaces of the cooking equipment with the combined first and second aqueous cleaning solutions by one or more of: spraying the combined solutions under pressure through the nozzle onto the soiled surfaces; recirculating the combined solutions over the soiled surfaces; and placing the soiled surfaces in the holding tank with the combined solutions; and e) allowing the combined first and second aqueous cleaning solutions to contact the soiled surfaces of the food processing equipment for a period of time sufficient to clean them.

2. The method of claim 1, wherein the first aqueous cleaning solution further comprises alkali metal salts of organophosphonic acid soil dispersants and scale inhibitors selected from the group consisting of: amino tris(methylenephosphonic acid); 1-hydroxyethylidene disphosphonic acid; and 2-phosphono-1,2,4-butanetricarboxylic acid in an amount of from about 0.1 to about 5.0 percent by weight, based on the total weight of the first aqueous cleaning solution.

3. The method of claim 1, wherein the first aqueous cleaning solution further comprises at least one surfactant selected from the group consisting of: disodium cocoamphodipropionate; alkyl polysaccacharide ether; monosodium N-lauryl-β-iminodipropionate; and dodecyldimethylamine oxide in an amount of from about 0.1 to about 10.0 percent, by weight, based on the total weight of the first aqueous cleaning solution.

4. The method of claim 1, wherein the first aqueous cleaning solution further comprises at least one hydrophobe phase coupling agent selected from the group consisting of: sodium alkylnaphthalene sulfonate; sodium xylene sulfonate; and sodium cumene sulfonate; in an amount of from about 0.1 to about 10.0 percent, by weight, based on the total weight of the first aqueous cleaning solution.

5. The method of claim 1, wherein the first aqueous cleaning solution further comprises at least one inorganic salt selected from the group consisting of sodium metasilicate pentahydrate, liquid potassium silicate and sodium tripolyphosphate in an amount of from about 0.1 to about 10.0 percent by weight, based on the total weight of the first aqueous cleaning solution.

6. The method of claim 1, wherein the first aqueous cleaning solution further comprises at least one hydroxide anion wetting agents selected from the group consisting of: sodium gluconate; block, graft and network heteropolymers of ethylene oxide and propylene oxide; and sodium glucoheptonate in an amount of from about 0.1 to about 10.0 percent by weight, based on the total weight of the first aqueous cleaning solution.

7. The method of claim 1, wherein the first aqueous cleaning solution further comprises at least one defoamer selected from the group consisting of: polydimethylsiloxane emulsions; and non-silicone defoamers, in an amount of from about 0.001 to about 1.0 percent by weight, based on the total weight of the first aqueous cleaning solution.

8. The method of claim 1, wherein the first aqueous cleaning solution further comprises at least one chelant or sequestrant selected from the group consisting of: citric acid; sodium citrate; ethylenediaminetetracetic acid of salts thereof; and methyltrinitriloacetic acid, in an amount of from about 0.1 to about 10.0 percent by weight, based on the total weight of the first aqueous cleaning solution.

9. A method for the cleaning of components of food processing equipment, in place, without disassembly, the components having soiled surfaces, by using a cleaning formulation containing an aqueous combination of hydroxide ion and an oxidizing agent, comprising the sequential steps of:

a) preparing a first aqueous cleaning solution comprising:
   i) from approximately 0.1 percent by weight to approximately 50 percent by weight, based on the total weight of the first aqueous cleaning solution, of an alkali metal hydroxide selected from the group consisting of lithium hydroxide, sodium hydroxide and potassium hydroxide, based on the total weight of the first aqueous cleaning solution, and ii) alkali metal salts of soil dispersants comprising acrylate monomers having a weight average molecular weight range of from about 1,000 to about 12,000 g/mole in an amount of from about 0.1 percent to about 5.0 percent by weight, based on the total weight of the first aqueous cleaning solution;

b) preparing a second aqueous cleaning solution comprising:

i) from approximately 0.1 percent by weight to approximately 50 percent by weight, based on the total weight of the second aqueous cleaning solution, of at least one of: hydrogen peroxide, and a compound that generates aqueous hydrogen peroxide when dissolved in water;

ii) from approximately 0.1 percent by weight to approximately 10 percent by weight, based on the total weight of the second aqueous cleaning solution, of a dispersant; and iii) from approximately 0.2 to approximately 3.0 percent by weight, based on the total weight of the second aqueous cleaning solution, of a peroxide beach activator that generates surface-active peracids; then c) combining the first aqueous cleaning solution with the second aqueous cleaning solution to generate perhydroxyl anion in a container selected from the group consisting of a pressure spraying device having a nozzle, a holding tank and a recirculation tank;

d) contacting the soiled surfaces of the cooking equipment with the combined first and second cleaning solutions by one or more of: spraying the combined solutions under pressure through the nozzle onto the soiled surfaces; recirculating the combined solutions over the soiled surfaces; and placing the soiled surfaces in the holding tank with the combined solutions; and e) allowing the cleaning formulation to contact the soiled surfaces of the food processing equipment for a period of time sufficient to clean them.

10. The method of claim 9, wherein the first aqueous cleaning solution further comprises alkali metal salts of organophosphonic acid soil dispersants and scale inhibitors selected from the group consisting of: amino tris(methylenephosphonic acid); 1-hydroxyethylidene disphosphonic acid; and 2-phosphono-1,2,4-butanetricarboxylic acid in an amount of from about 0.1 to about 5.0 percent by weight, based on the total weight of the first aqueous cleaning solution.

11. The method of claim 9, wherein the first aqueous cleaning solution further comprises at least one surfactant selected from the group consisting of: disodium cocoamphodipropionate; alkyl polysaccacharide ether; monosodium N-lauryl-β-iminodipropionate; and dodecyldimethylamine oxidein an amount of from about 0.1 to about 10.0 percent, by weight, based on the total weight of the first aqueous cleaning solution.

12. The method of claim 9, wherein the first aqueous cleaning solution further comprises at least one hydrophobe phase coupling agent selected from the group consisting of: sodium alkylnaphthalene sulfonate; sodium xylene sulfonate; and sodium cumene sulfonate; in an amount of from about 0.1 to about 10.0 percent, by weight, based on the total weight of the first aqueous cleaning solution.

13. The method of claim 9, wherein the first aqueous cleaning solution further comprises at least one inorganic salt selected from the group consisting of sodium metasilicate pentahydrate, liquid potassium silicate and sodium tripolyphosphate in an amount of from about 0.1 to about 10.0 percent by weight, based on the total weight of the first aqueous cleaning solution.

14. The method of claim 9, wherein the first aqueous cleaning solution further comprises at least one hydroxide anion wetting agents selected from the group consisting of: sodium gluconate; block, graft and network heteropolymers of ethylene oxide and propylene oxide; and sodium glucoheptonate in an amount of from about 0.1 to about 10.0 percent by weight, based on the total weight of the first aqueous cleaning solution.

15. The method of claim 9, wherein the first aqueous cleaning solution further comprises at least one defoamer selected from the group consisting of: polydimethylsiloxane emulsions; and non-silicone defoamers, in an amount of from about 0.001 to about 1.0 percent by weight, based on the total weight of the first aqueous cleaning solution.

16. The method of claim 9, wherein the first aqueous cleaning solution further comprises at least one chelant or sequestrant selected from the group consisting of: citric acid; sodium citrate; ethylenediaminetetracetic acid of salts thereof; and methyltrinitriloacetic acid, in an amount of from about 0.1 to about 10.0 percent by weight, based on the total weight of the first aqueous cleaning solution.

17. A method for cleaning the soiled surface components of food processing equipment used for the deep fat frying of edible foodstuffs, using an aqueous combination of hydroxide ion and an oxidizing agent, comprising the sequential steps of:

a) preparing a first aqueous cleaning solution comprising:

i) from approximately 0.1 percent by weight to approximately 50 percent by weight, based on the total weight of the first aqueous cleaning solution, of an alkali metal hydroxide selected from the group consisting of lithium hydroxide, sodium hydroxide and potassium hydroxide, based on the total weight of the first aqueous cleaning solution, and ii) alkali metal salts of soil dispersants comprising acrylate monomers having a weight average molecular weight range of from about 1,000 to about 12,000 g/mole in an amount of from about 0.1 percent to about 5.0 percent by weight, based on the total weight of the first aqueous cleaning solution;

b) preparing a second aqueous cleaning solution comprising:

i) from approximately 0.1 percent by weight to approximately 50 percent by weight, based on the total weight of the second aqueous cleaning solution, of at least one of: hydrogen peroxide, and a compound that generates aqueous hydrogen peroxide when dissolved in water;

ii) from approximately 0.1 percent by weight to approximately 10 percent by weight, based on the total weight of the second aqueous cleaning solution, of a dispersant; and iii) from approximately 0.2 to approximately 3.0 percent by weight, based on the total weight of the second aqueous cleaning solution, of a peroxide bleach activator that generates surface-active peracids; then c) adding the first aqueous cleaning solution to a volume of water contained in the food processing equipment, followed by adding the second aqueous cleaning solution with mixing to generate perhydroxyl anion; and finally d) heating the combined cleaning solutions during a soaking or recirculation period within or around the soiled food processing components.

18. The method of claim 17, wherein the first aqueous cleaning solution further comprises alkali metal salts of organophosphonic acid soil dispersants and scale inhibitors selected from the group consisting of: amino tris(methylenephosphonic acid); 1-hydroxyethylidene disphosphonic acid; and 2-phosphono-1,2,4-butanetricarboxylic acid in an amount of from about 0.1 to about 5.0 percent by weight, based on the total weight of the first aqueous cleaning solution.

19. The method of claim 17, wherein the first aqueous cleaning solution further comprises at least one surfactant selected from the group consisting of: disodium cocoamphodipropionate; alkyl polysaccacharide ether; monosodium N-lauryl-β-iminodipropionate; and dodecyldimethylamine oxidein an amount of from about 0.1 to about 10.0 percent, by weight, based on the total weight of the first aqueous cleaning solution.

20. The method of claim 17, wherein the first aqueous cleaning solution further comprises at least one hydrophobe phase coupling agent selected from the group consisting of: sodium alkylnaphthalene sulfonate; sodium xylene sulfonate; and sodium cumene sulfonate; in an amount of from about 0.1 to about 10.0 percent, by weight, based on the total weight of the first aqueous cleaning solution.

21. The method of claim 17, wherein the first aqueous cleaning solution further comprises at least one inorganic salt selected from the group consisting of sodium metasilicate pentahydrate, liquid potassium silicate and sodium tripolyphosphate in an amount of from about 0.1 to about 10.0 percent by weight, based on the total weight of the first aqueous cleaning solution.

22. The method of claim 17, wherein the first aqueous cleaning solution further comprises at least one hydroxide anion wetting agents selected from the group consisting of: sodium gluconate; block, graft and network heteropolymers of ethylene oxide and propylene oxide; and sodium glucoheptonate in an amount of from about 0.1 to about 10.0 percent by weight, based on the total weight of the first aqueous cleaning solution.

23. The method of claim 17, wherein the first aqueous cleaning solution further comprises at least one defoamer selected from the group consisting of: polydimethylsiloxane emulsions; and non-silicone defoamers, in an amount of from about 0.001 to about 1.0 percent by weight, based on the total weight of the first aqueous cleaning solution.

24. The method of claim 17, wherein the first aqueous cleaning solution further comprises at least one chelant or sequestrant selected from the group consisting of: citric acid; sodium citrate; ethylenediaminetetracetic acid of salts thereof; and methyltrinitriloacetic acid, in an amount of from about 0.1 to about 10.0 percent by weight, based on the total weight of the first aqueous cleaning solution.

* * * * *